US009138080B2

(12) United States Patent
Kesterson et al.

(10) Patent No.: US 9,138,080 B2
(45) Date of Patent: Sep. 22, 2015

(54) ROTATABLE TURRET ASSEMBLY FOR CHECKOUT STAND

(71) Applicant: Royston LLC, Jasper, GA (US)

(72) Inventors: Jim Kesterson, Jasper, GA (US); John Wann, Jasper, GA (US); Larry Segars, Jasper, GA (US); Roger Bowersox, Jasper, GA (US)

(73) Assignee: ROYSTON LLC, Jasper, GA (US)

( * ) Notice: Subject to any disclaimer, the term of this patent is extended or adjusted under 35 U.S.C. 154(b) by 0 days.

(21) Appl. No.: 14/283,272

(22) Filed: May 21, 2014

(65) Prior Publication Data

US 2014/0360816 A1 Dec. 11, 2014

Related U.S. Application Data

(60) Provisional application No. 61/826,018, filed on May 21, 2013.

(51) Int. Cl.

| | |
|---|---|
| ***A47F 9/04*** | (2006.01) |
| ***A47F 10/00*** | (2006.01) |
| *A47F 10/02* | (2006.01) |

(52) U.S. Cl.
CPC . *A47F 9/04* (2013.01); *A47F 10/00* (2013.01); *A47F 10/02* (2013.01); *A47F 2009/041* (2013.01)

(58) Field of Classification Search
CPC ..... A47F 9/04; A47F 2009/041; A47F 10/00; A47F 10/02
USPC ..... 186/59, 67; 211/163
See application file for complete search history.

(56) References Cited

U.S. PATENT DOCUMENTS

2007/0138269 A1* 6/2007 Baitz et al. ..... 235/383

* cited by examiner

*Primary Examiner* — Mark Beauchaine
(74) *Attorney, Agent, or Firm* — Seyfarth Shaw LLP; Nigamnarayan Acharya

(57) ABSTRACT

A checkout stand having a circular turret rotatable about a central axis and a damping cylinder including a piston rod. The first end of the rod is pivotally attached to a location outside the perimeter of the turret, and the second end of the rod is pivotally attached to a location on the circular turret offset from the central axis.

20 Claims, 4 Drawing Sheets

ROTATABLE TURRET ASSEMBLY FOR CHECKOUT STAND

CROSS REFERENCES TO RELATED APPLICATIONS

This application claims the benefit of U.S. Provisional Patent Application Ser. No. 61/826,018, entitled: "Rotatable Turret Assembly for Checkout Stand" filed May 21, 2013, the content of which is incorporated herein by reference in its entirety.

TECHNICAL FIELD

This disclosure relates to a checkout stand, and more particularly to a rotatable turret set within a checkout stand.

BACKGROUND

A checkout stand is a station at which a customer in a store, such as a grocery store, unloads the items he or she intends to purchase, i.e., groceries, a register clerk scans or enters the prices of the items. A number of checkout stands are usually lined so that multiple customers can assemble their items and purchase them on the way out of the store. These checkout stands are used by stores that sell several items to an individual customer. Bar codes on items of merchandise are scanned by a scanner or bar code reader. The items may then be moved to a bagging area, either automatically by a transport belt, or manually. Some checkout stands may include a scale for weighing items such as produce. Customers pay for the merchandise at a tender or payment section of the checkout stand.

Accordingly, there is always a need for an improved checkout stand. This disclosure is directed this need, among others.

SUMMARY

Certain embodiment provide a checkout stand with a rotatable turret able to support the weight of a register, or other objects. A computer display, payment station, scale or the like, rests on top of or within the stand of rotatable turret. The top surface supports most of the weight of the computer display and the payment station.

In one specific embodiment, a checkout stand have a circular turret rotatable about a central axis, a cabinet surface at least partially surrounding a perimeter of the circular turret, and a damping cylinder including a piston rod having a first end and a second end.

In another specific embodiment, the checkout stand has a circular turret rotatable, a pair of stops protruding from the circular turret at opposite locations, a display mounted on a top surface of the circular turret, and a cabinet surface at least partially surrounding a perimeter of the circular turret. A damping cylinder can include a piston rod, the piston rod having a first end and a second end. The first end of the piston rod is pivotally attached to a location outside the perimeter of the circular turret, and the second end of the piston rod is pivotally attached to a location on the circular turret offset from the central axis, such that when the circular rotatable turret rotates from a first position abutting one of the stops to a second position abutting the other one of the stops. The rotation may slow as the circular rotatable turret approaches the second position and/or the rotation may slow when the circular turret rotates from the second position to the first position. In one example, the cylinder provides pneumatic assistance during about a half of the arc and hydraulic dampening during about half of the arc.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION

Described and shown herein are various specific embodiments of a checkout stand that is convertible between a cashier mode and a self-service or customer mode. In the cashier mode, the display can face in one direction for operation by a cashier standing or sitting at one side of the checkout stand. In the self-service mode the display can face in the opposite direction for operation by a customer standing at the opposite side of the checkout stand. To this end, the display sits on a circular turret assembly which rotates between the cashier position and the customer position, such that the display rotates with the turret assembly.

Figure 1:
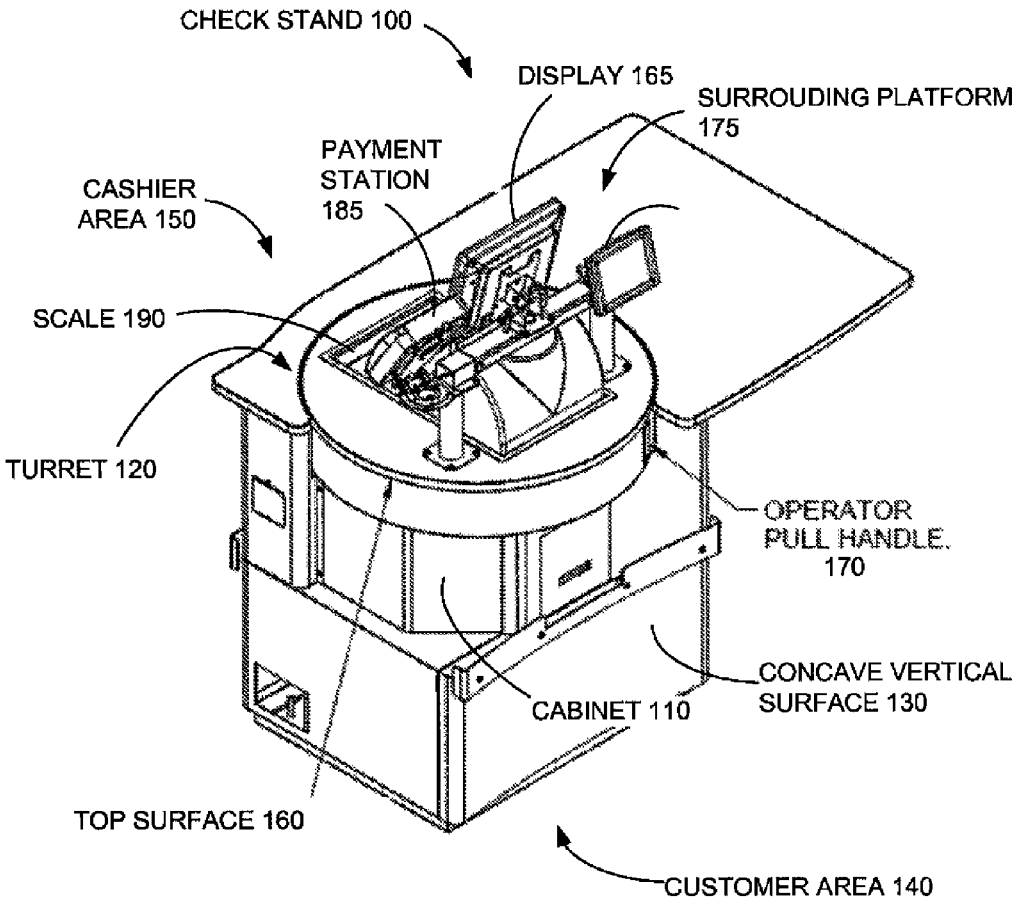
FIG. 1 is a perspective view of a checkout stand with rotatable turret in the cashier facing position according one specific embodiment.
Figure 2:
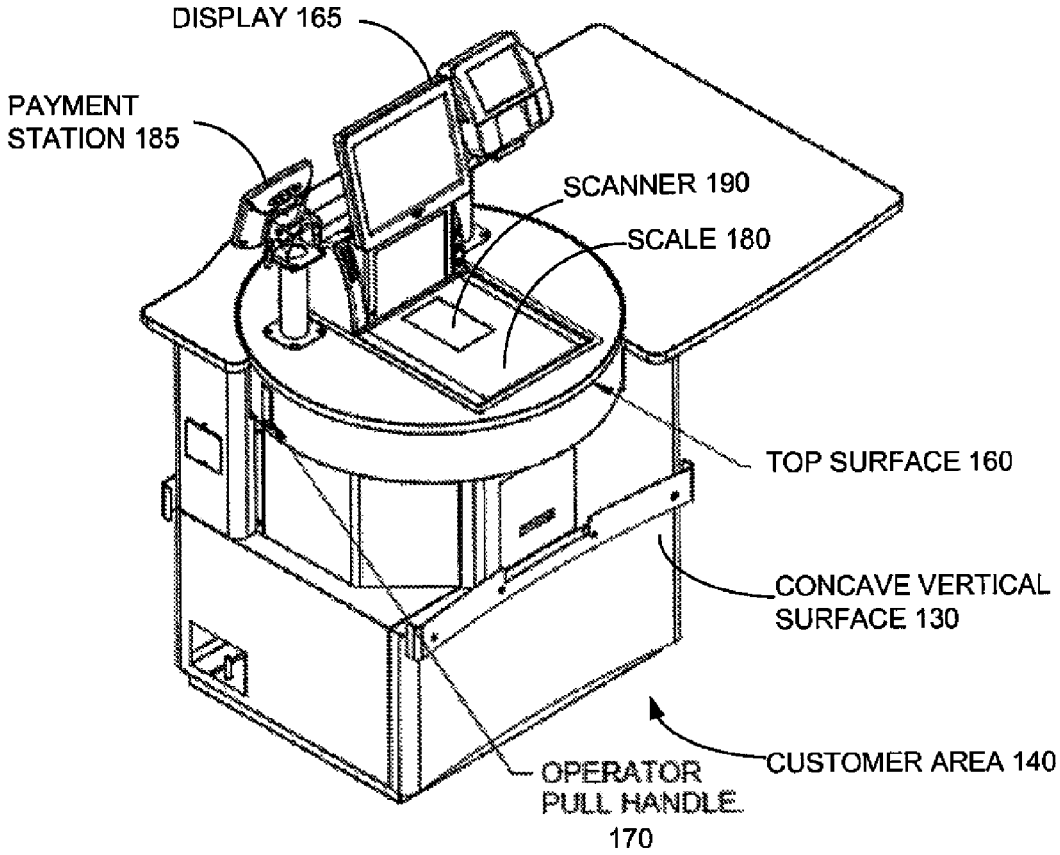
FIG. 2 is a perspective view of a checkout stand with rotatable turret in the customer facing position.
Figure 3:
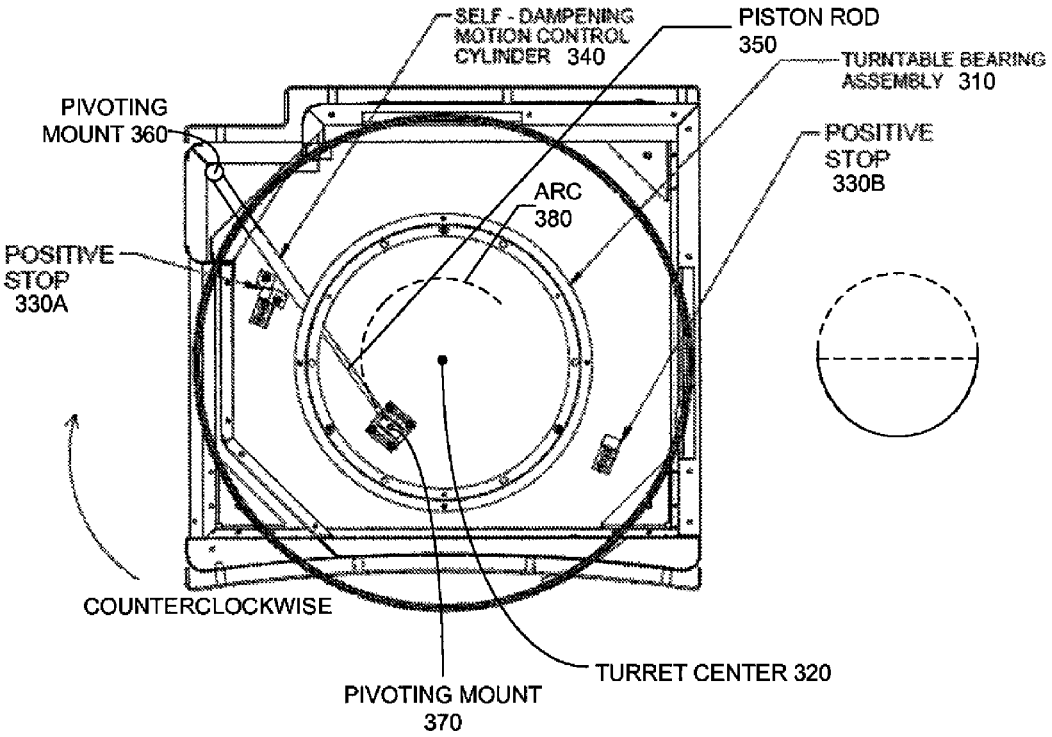
FIG. 3 is a top view of a cross section of the rotatable turret when in the cashier facing position.
Figure 4:
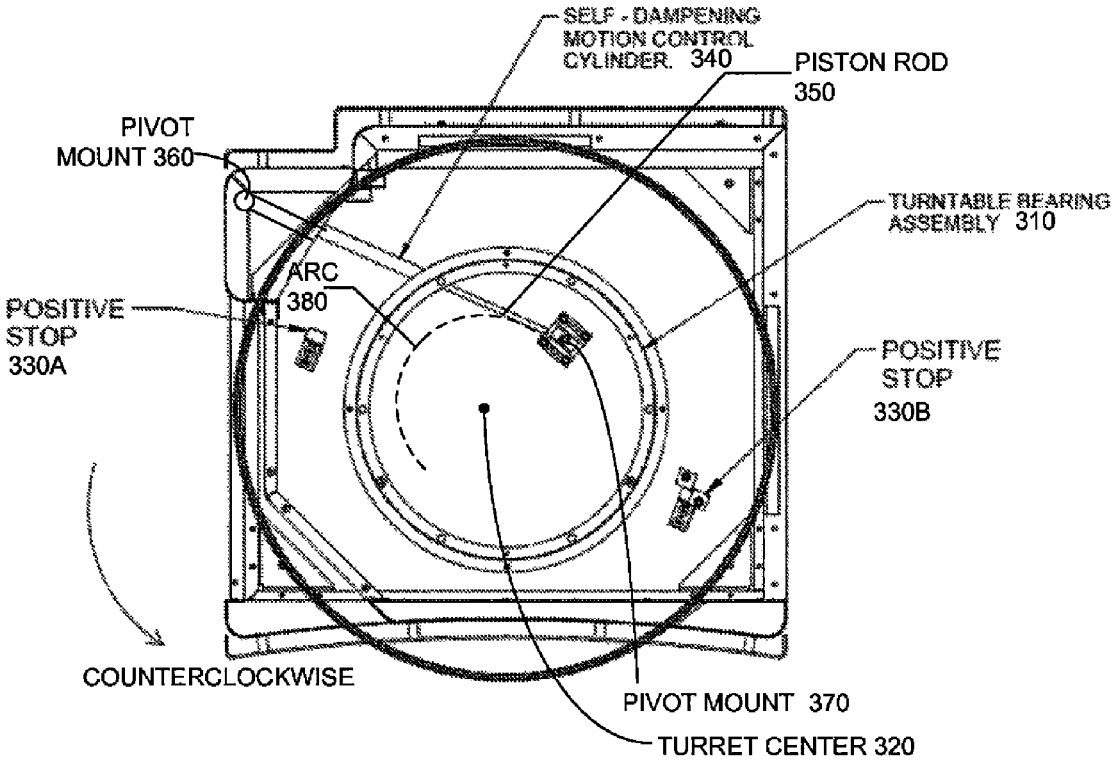
FIG. 4 is a top view of a cross section of the rotatable turret when in the customer facing position, according to some embodiments disclosed herein.

The structure and operation of the inventive checkout stand will now be described in further detail with reference to several figures. FIG. 1 is a perspective view of a checkout stand with rotatable turret in the cashier facing position, according to some embodiments disclosed herein. FIG. 2 is a perspective view of a checkout stand with rotatable turret in the customer facing position, according to some embodiments disclosed herein. FIG. 3 is a top view of a cross section of the rotatable turret when in the cashier facing position, according to some embodiments disclosed herein. FIG. 4 is a top view of a cross section of the rotatable turret when in the customer facing position, according to some embodiments disclosed herein.

FIG. 1 illustrates a checkout stand 100 in a cashier mode. Checkout stand 100 includes a cabinet 110 and a circular rotatable turret 120. One side of cabinet 110 includes a concave vertical surface 130, defining a customer area 140 in which a customer stands. The opposite side of cabinet 110 then defines a cashier area 150 in which a cashier may stand or sit in the cashier mode of operation. Rotatable turret 120 includes a top surface 160 and a checkout display 165 is mounted on top surface 160. As noted above, turret 120 rotates between two positions that are 180 degrees apart. In the cashier position illustrated in FIG. 1, turret 120 is at the 0 degree position of rotation, with checkout display 165 and payment station 185 facing cashier area 150. The rotation of turret 120 may be initiated by a handle 170.

Cabinet 110 also includes a platform 175 at least partially surrounding turret 120, a portion of which may be used by an operator as a bagging area. Checkout stand 100 also includes a scale 180 and a scanner (not shown) mounted within rotatable turret 120, and a payment station 185.

FIG. 2 illustrates checkout stand 100 in a customer mode. In this mode, turret 120 rests at the 180 degree position of rotation, with checkout display 165 and payment station 185 facing customer area 140. A scanner 190 mounted within the rotatable turret 120 can be seen in this view. Checkout display 165 is located at an offset from the center of rotatable turret 120 and is positioned such that when turret 120 is in the 180 degree (customer) position, checkout display 165 is farther away from the customer area 140, thus allowing the customer operator unobstructed access to scale 180 and scanner 190. Similarly, when turret 120 is in the 0 degree (cashier) position, checkout display 165 is farther away from cashier area 150, thus allowing the cashier unobstructed access to scale 180 and scanner 190.

FIG. 3 is a top view of a cross section of rotatable turret 120, in the cashier facing position where rotatable turret 120 rests in the 0 degree position against stop 330A. Rotatable turret 120 includes a turntable bearing assembly 310 which supports top surface 160 (not visible in FIG. 3). Turntable bearing assembly 310 rotates about a central axis defined by turret center 320. Rotation of turret 120 is limited, by a pair of positive stops 330A and 330B, to rotation between a 0 degree position and a 180 degree position. A damping cylinder 340 regulates the speed of rotation of rotatable turret 120, decreasing the speed as turret 120 approaches and then comes to rest at either of the positive stops 330A, B. Damping cylinder 340 includes a piston rod 350 which extends through the base of the cylinder. In various embodiments, damping cylinder 340 may take the form of a pneumatic cylinder, a hydraulic cylinder, or other types of cylinders which damp the motion of piston. In one embodiment, the cylinder provides pneumatic assistance during about a half of the arc and hydraulic dampening during about half of the arc.

One end of piston rod 350 is attached to an outer pivoting mount 360 that is located outside the periphery of circular rotatable turret 120, for example, on cabinet 110. The other end of piston rod 350 is attached to an inner pivoting mount 370 that is located in the rotatable turret 120. More specifically, inner pivoting mount 370 is located at an offset from turret center 320, so that as turret 120 rotates, inner pivoting mount 370 describes an arc 380 that is concentric with respect to turret center 320.

During this rotation, piston rod 350 first extends through damping cylinder 340 as the distance between inner pivoting mount 370 and outer pivoting mount 360 increases, then retracts into damping cylinder 340 as the distance between the mounts decreases. At the start of the rotation, damping cylinder 340 causes or allows turret 120 to pick up speed. Then, as piston rod 350 withdraws into damping cylinder 340, the damping fluid (gas or liquid) in the cylinder is compressed and the resistance causes the speed of rotation to slow. Turret 120 continues to slow until coming to rest against stop 330B. This slower speed results in less force when rotatable turret 120 contacts stop 330B. The damping cylinder causes rotation of the turret to slow as the turret approaches the second position or the first position This reduced force is in turn beneficial to weight scale 180 mounted within rotatable turret 120, since scale 180 can be knocked out of calibration by excessive force on, shock to, and/or jarring of the scale 180

FIG. 4 is a top view of a cross section of rotatable turret 120, in the customer facing position where rotatable turret 120 rests in the 180 degree position against stop 330B. At a stop position, pressure within damping cylinder 340 holds rotatable turret 120 and checkout display 165 mounted on turret 120 in place. When an operator engages one of handles 170, the release pushes rotatable turret 120 back in the opposite direction, and damping cylinder 340 regulates the rotation in the same manner, slowly bringing it to rest against the other stop, 330A.

In certain embodiments, tight tolerances of the dimensions of the rotatable turret 120 enable minimal tilt or no tilt of the rotatable turret 120 relative to the checkout stand 20. The tubular bearing assembly 310 having a vertical axis A, and found for example within the second tubular bearing 315, acts as an axle about which the second tubular bearing 315 rotates. The coaxial relationship keeps the rotatable turret 120 centered within the check stand 100 and also provides a bearing surface for the stand to rotate.

In certain specific embodiment, the display may be offset from the center of the circular turret assembly such that the display is closer to a cashier side of the checkout stand in cashier mode, and closer to the opposite (customer) side of the checkout stand in self-service mode. For embodiments in which a scanner is mounted on or within the rotatable turret assembly, this offset location for the display allows the checkout stand operator (cashier or customer) unobstructed access to the scanner. A scale may be disposed within the rotatable turret assembly, allowing the operator to weigh items placed on a top surface of the platform.

In other embodiments, a turntable bearing assembly can allow the circular turret assembly to rotate about a central axis. The rotation of the turret may be motorized or motor assisted. A first positive stop or detent protruding from the perimeter of the turret limits rotation of the turret in a counterclockwise direction by frictional contact between the stop and another surface. The location of this first stop may be referred to herein as the 0 degree platform position. A second positive stop or detent protrudes from a perimeter of the turret assembly at a location opposite from (180 degrees from) the first positive stop. The location of this second stop may be referred to herein as the 180 degree platform position. The stops cooperate to limit rotation of the turret to a semicircle or a 180 degree arc. That is, the turret rotates from the 0 degree position (e.g., the cashier's position) to the 180 degree position (e.g., the customer position) and back to the 0 degree (cashier) position, but does not rotate between the 180 degree position to the 360 degree position.

The rotational motion and speed can be controlled by a damping cylinder so that the speed decreases as the turret approaches and comes to rest at either of the positive stops. This reduction in speed avoids sudden force or shock to the scale mounted within the platform. Since a scale subjected to such forces may need to be frequently recalibrated, the rotational motion control avoids frequent recalibration.

Once turret rotation begins, the damping cylinder controls the motion of the turret as it spins on its bearing. The cylinder regulates the speed of rotation, and once the turret reaches the 90 degree position (midway between the two stops), the fluid pressure in the cylinder pushes the platform toward the 180 degree (opposite) position. As the turret approaches the 180 degree (customer) position, the damping function of the fluid in the cylinder slows the motion of the platform as it comes to rest against the second positive stop. The same process of regulated motion occurs in the opposite direction: motion starts at the 180 degree (e.g., customer) position in a counterclockwise direction, and once the platform reaches the 90 degree position the fluid pressure pushes the platform back toward the 0 degree (e.g., cashier) position until the turret comes to rest against the first stop at the 0 degree (cashier) position.

In some embodiments, an operator sets the rotation process in motion by engaging an optional handle located on the turret, for example, a pull handle mounted on an outer perimeter of the turret. As noted above, the rotation is regulated by the damping cylinder. Once the platform has reached the full extent of rotation (180 degree), fluid pressure in the cylinder holds the turret in place. The operator pulls the handle again to initiate rotation in the opposite direction.

In some embodiments, the checkout stand can have a lock or an actuated lock (not shown) to essentially secure the position of the turret within the checkout stand. In such embodiments, the lock when engaged prevents or keeps the turret from rotating and thereby maintains the position of the turret along the concentric arc. Such a lock can be an ordinary lock, such an lock and pin type of lock.

In some embodiments, tight tolerances of the dimensions of the cylinders 22 and 28 enable minimal tilt or no tilt of the carousel relative to the surrounding 100. The first cylindrical tube 22 having a vertical axis A, and found for example within the second cylindrical tube 28, acts as an axle about which the second cylindrical tube 28 rotates. The coaxial relationship keeps the carousel 16 centered beneath the stand 14 and also provides a bearing surface for the stand to spin.

Those skilled in the art will recognize, or be able to ascertain using no more than routine experimentation, many equivalents to the specific embodiments of the invention described herein. Such equivalents are intended to be encompassed by the following claims.

What is claimed:

1. A checkout stand assembly, the checkout stand assembly comprising:

(a) a circular turret rotatable about a central axis, (b) a stop on a semicircular arc concentric with the central axis, (c) a cabinet surface at least partially surrounding a perimeter of the circular turret, (d) a damping cylinder including a piston rod, the piston rod having a first end and a second end, wherein the first end is pivotally attached to a location outside the perimeter of the circular turret, the second end is pivotally attached to a location on the circular turret offset from the central axis, such that when the circular rotatable turret rotates from a first position abutting the stop to a second position abutting another stop, the cylinder provides pneumatic assistance during about a half of the arc and hydraulic dampening during about half of the arc, and whereby the damping cylinder causes rotation of the turret to slow as the turret approaches the second position or the first position.

2. The assembly as claimed in claim 1, further comprising a cabinet at least partially surrounding a perimeter of the circular turret.

3. The assembly as claimed in claim 2, wherein the stops protrude from the circular turret at opposite locations on a semicircular arc concentric with the central axis.

4. The assembly as claimed in claim 1, further comprising at least two stops protruding from the circular turret at opposite locations on a semicircular arc concentric with the central axis.

5. The assembly as claimed in claim 1, further comprising a display mounted on a top surface of the circular turret.

6. The assembly as claimed in claim 1, further comprising a lock along the arc.

7. A checkout stand comprising:

(a) a circular turret rotatable about a central axis, (b) a cabinet surface at least partially surrounding a perimeter of the circular turret, and (c) a damping cylinder including a piston rod having a first end and a second end.

8. The checkout stand as claimed in claim 7, wherein the first end is pivotally attached to a location outside the perimeter of the circular turret, the second end is pivotally attached to a location on the circular turret offset from the central axis, such that when the circular rotatable turret rotates from a first position abutting a stop to a second position.

9. The checkout stand as claimed in claim 7, whereby the damping cylinder causes rotation of the turret to slow as the turret approaches the second position, and when the circular turret rotates from the second position to the first position.

10. The checkout stand as claimed in claim 7, further comprising a stop on a semicircular arc concentric with the central axis.

11. The checkout stand as claimed in claim 10, wherein the stop protrudes from the circular turret.

12. The checkout stand as claimed in claim 7, further comprising a display mounted on a top surface of the circular turret.

13. The checkout stand as claimed in claim 7, further comprising a cabinet at least partially surrounding the turret.

14. The checkout stand as claimed in claim 7, wherein the piston rod withdraws into the damping cylinder, and damping fluid in the cylinder is compressed and the resistance causes the speed of rotation of the turret to slow.

15. The checkout stand as claimed in claim 7, further comprising a handle.

16. The checkout stand as claimed in claim 7, wherein rotation of the turret is motorized.

17. The checkout stand as claimed in claim 7, wherein the damping cylinder holds the turret in place.

18. A turret rotatable about a central axis comprising:

(a) a pair of stops protruding from the circular turret at opposite locations on a semicircular arc concentric with the central axis, (b) a damping cylinder including a piston rod, the piston rod having a first end and a second end, wherein the first end pivotally attached to a location outside the perimeter of the circular turret, the second end pivotally attached to a location on the circular turret offset from the central axis, such that when the circular rotatable turret rotates from a first position abutting one of the stops to a second position abutting the other one of the stops, and whereby rotation slows as the circular rotatable turret approaches the second position, and when the circular turret rotates from the second position to the first position, the rotation slows as the circular rotatable turret approaches the first position.

19. The turret as claimed in claim 18, further comprising a display mounted on a top surface of the circular turret.

20. The turret as claimed in claim 18, further comprising a scale.

* * * * *